US008636877B2

(12) United States Patent
Palmer

(10) Patent No.: US 8,636,877 B2
(45) Date of Patent: Jan. 28, 2014

(54) SACRIFICIAL ANODE SYSTEM

(76) Inventor: Joseph Palmer, Chelmsford (CA)

( * ) Notice: Subject to any disclaimer, the term of this patent is extended or adjusted under 35 U.S.C. 154(b) by 285 days.

(21) Appl. No.: 13/024,946

(22) Filed: Feb. 10, 2011

(65) Prior Publication Data

US 2011/0240485 A1 Oct. 6, 2011

Related U.S. Application Data

(60) Provisional application No. 61/319,296, filed on Mar. 31, 2010.

(51) Int. Cl.

| | |
|---|---|
| ***C23F 13/10*** | (2006.01) |
| ***C23F 13/06*** | (2006.01) |
| ***C23F 13/12*** | (2006.01) |
| ***C23F 13/16*** | (2006.01) |
| ***C23F 13/18*** | (2006.01) |
| ***C23F 13/20*** | (2006.01) |

(52) U.S. Cl.

USPC ..... 204/196.17; 204/196.1; 204/196.15; 204/196.3; 204/196.37; 205/725; 205/726; 205/727; 205/730; 205/735; 205/740

(58) Field of Classification Search

USPC ..... 204/196.1, 196.15, 196.17, 196.3, 204/196.37; 205/725, 726, 727, 730, 735, 205/740

See application file for complete search history.

(56) References Cited

U.S. PATENT DOCUMENTS

| | | | | |
|---|---|---|---|---|
| 3,892,032 | A * | 7/1975 | Bagnulo | 29/455.1 |
| 4,140,614 | A * | 2/1979 | McKie | 204/196.15 |
| 4,170,532 | A * | 10/1979 | Tatum | 204/196.3 |
| 4,376,753 | A * | 3/1983 | Lucas | 376/305 |
| 4,487,672 | A * | 12/1984 | Vrable | 205/731 |
| 5,358,423 | A * | 10/1994 | Burkhard et al. | 439/402 |
| 5,458,441 | A * | 10/1995 | Barry | 405/170 |
| 5,739,424 | A * | 4/1998 | Beavers | 204/196.02 |
| 6,423,208 | B1 * | 7/2002 | Russell | 205/730 |
| 7,655,116 | B1 * | 2/2010 | Tilsner | 204/196.15 |
| 8,133,381 | B2 * | 3/2012 | Ersoy | 205/740 |
| 2010/0201117 | A1 * | 8/2010 | Lin | 285/53 |

* cited by examiner

*Primary Examiner* — Bruce Bell

(74) *Attorney, Agent, or Firm* — McDermott Will & Emery LLP

(57) ABSTRACT

A sacrificial anode system and associated surface pipe system maintenance method designed to protect surface pipes and associated parts. According to a first aspect of the present invention, the sacrificial anode system is installable at an interface between a first pipe and a second pipe and comprises an insertion sleeve shaped to fit along an inner surface of the first pipe, a flange attached to the insertion sleeve and shaped to rest against an end surface of the first pipe, a sacrificial anode to be positioned within the first pipe, and a stem linking the sacrificial anode to the insertion sleeve. According to a second aspect of the present invention, a method for maintaining a surface pipe system is also provided.

8 Claims, 14 Drawing Sheets

SACRIFICIAL ANODE SYSTEM

RELATED APPLICATIONS This application is the Non-Provisional of U.S. Provisional Application No. 61/319,296, filed on Mar. 31, 2010, the disclosure of which Application is incorporated by reference herein.

FIELD OF THE INVENTION

The present invention generally relates to sacrificial anode. More particularly, it relates to a sacrificial anode system to be used in combination with grooved pipes and a method for maintaining a surface pipe system provided with a sacrificial anode system.

BACKGROUND OF THE INVENTION

It is known that corrosion imposes havoc on the grooved pipe industry. Grooved pipe technology is a method by which pipes and associated components are joined together through a clamp or a coupling. In such configurations, the ends of the pipes to be joined and associated components have grooved interfaces that allow the clamp or coupling to hold adjacent components together. The clamp or coupling is also provided with a rubber gasket or seal in order to seal the joint between the pipes.

Grooved pipe components were developed during the First World War as a mean to quickly deliver fuel and water supplies to Allied forces. Following the war, this efficient method of joining pipes was adapted for everyday use in modern society. Given their ease of use and adaptable characteristics, grooved pipes have developed into a very important industry in North America, as well as in other regions.

Several different types of suppliers, distributors and manufacturers are currently involved in the production and distribution of grooved pipes and their associated products, which are used in industries of various types. As an example, grooved pipes are used for, but not limited to, the mining industry, the pulp and paper industry, the oil and gas industry, the power generation industry, institutional facilities and many other industries requiring fluid handling applications.

In terms of applications, grooved pipes are usually used for, but not limited to, heating, ventilation and air conditioning (HVAC), fire Suppression Systems, water distribution, waste removal and oil field operations.

As will be detailed below, in certain circumstances, the lifespan of grooved pipes can be greatly enhanced by the combination of such pipes with a sacrificial anode system.

A sacrificial anode or sacrificial rod is a metallic anode used in cathodic protection, where it is intended to be dissolved to protect other metal components. The main idea is that the more active metal (i.e. the anode) oxidized more easily than the protected metal (i.e. the cathode) and corrodes first, hence the term sacrificial. Generally, the anode oxidizes nearly completely before the less active metal will corrode, therefore acting as a barrier against corrosion for the protected metal.

As shown in FIG. 1, when the sacrificial anode 16 is attached to a metal structure 11 to be protected, and the two are submersed in water or buried in the earth 50, an electrochemical cell is created. The earth or the water provides the ionic pathway necessary for cathodic protection to take place. Therefore, simply bolting a piece of active metal such as zinc to a less active metal, such as mild steel, and leaving it in the open air does not provide any protection, in the absence of the ionic pathway essential to cathodic protection.

Sacrificial anodes were discovered in the 1800s and have evolved a great deal since then. They are currently most commonly used, but are not limited to, the protection of underground water pipe lines, underground fuel pipe lines, underground storage tanks, steel pier piles, ship hulls (for both salted and fresh water), offshore oil platforms and outboard marine engines (for both salted and fresh water).

In the absence of the cathodic protection provided by the sacrificial anodes, the corrosion rate of the above mentioned structures would greatly increase. Consequently, the overall cost associated with the corrosion of the structures for individuals, businesses and government would be devastating. For example, without sacrificial anodes, water mains would never last the 30 plus years they are currently expected to.

Once an anode has expired, it usually can simply be replaced with a new one (i.e. once the anode is corroded away, it can be replaced with an uncorroded one). Anodes come in all shapes and sizes and are typically alloys of zinc, magnesium and aluminum.

It is important to bear in mind that for a sacrificial anode to work, both the structure and the anode must simultaneously be buried into the earth or submersed in water. It is the earth or the water that provides the ionic pathway to complete the electrochemical cell necessary for cathodic protection. Therefore, attaching an anode to a non submersed or buried pipe would provide no protection whatsoever.

Consequently, there is still presently a need for a sacrificial anode system that can be used in a non-submersed or non-buried pipe.

SUMMARY OF THE INVENTION

An object of the present invention is to provide a system that addresses at least one of the above-mentioned needs.

According to a first aspect of the present invention, there is provided a sacrificial anode system installable at an interface between a first pipe and a second pipe. The sacrificial anode system comprises an insertion sleeve shaped to fit along an inner surface of the first pipe; a flange attached to the insertion sleeve and shaped to rest against an end surface of the first pipe; a sacrificial anode to be positioned within the first pipe; and a stem linking the sacrificial anode to the insertion sleeve.

When used in combination with pipes provided with a ridge on the inner side of the pipe and proximate to the pipe end, the insertion sleeve and the flange of the sacrificial anode system preferably comprise a slotted opening extending perpendicularly along the entire length of the insertion sleeve and the flange.

Still when used in combination with pipes provided with a ridge on the inner side of the pipe and proximate to the pipe end, the insertion sleeve is preferably further provided with a groove running along the circumference of the insertion sleeve, proximate to the flange.

According to a second aspect of the present invention, there is also provided a method for maintaining a surface pipe system. The method comprises the steps of: a) providing a plurality of sacrificial anode systems for installation at various interfaces between adjacent pipes; b) installing the sacrificial anode systems at the interfaces; c) noting information related to the installation of the sacrificial anode systems; d) recording the information in a database; and e) scheduling maintenance activities based on the information recorded in the database.

Preferably, the sacrificial anode systems referred to, in the above-mentioned method for maintaining a surface pipe system, are sacrificial anode systems according to the first aspect of the present invention.

Still preferably, the database used in steps d) and e) of the method for maintaining a surface pipe system is a computerized database.

Alternatively, an additional step of physically tagging the pipes with at least one of the information recorded in the database can also be provided.

Other features of the present invention will become more apparent from the following description of preferred embodiments, and in reference to the appended drawings, given as examples only as to show how the invention may be put into practice.

DETAILED DESCRIPTION OF PREFERRED EMBODIMENTS OF THE INVENTION

Figure 1:
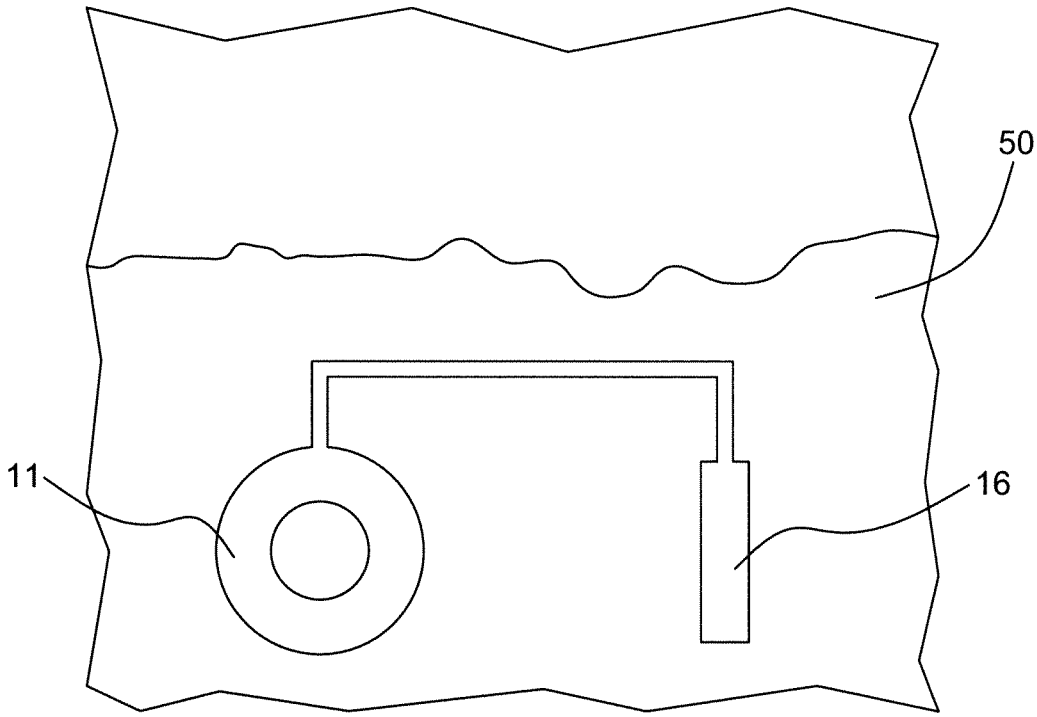
FIG. 1 (PRIOR ART)
FIG. 1 (PRIOR ART) is a schematic view of a prior art sacrificial anode system.

The system according to the present invention, which will be described in details below, will be commercialized under the name Scipsa™ system, the acronym standing for "Self-Contained Ionic Pathway Sacrificial Anode" system. The system is a two-part anti-corrosion and maintenance product designed to protect surface pipes and associated parts by providing an unobtrusive, easy to install, sacrificial anode that can be placed inside of surface pipes. The addition of the sacrificial anode system according to the present invention to a surface pipe system will help to increase the lifespan of the surface pipe system and associated components.

Given that surface pipes and valve systems are in open air and that there is therefore no ionic pathway to close the circuit between the anode and the metal pipe, up until now, surface pipe systems were typically non compatible with sacrificial anodes. By allowing the sacrificial anode to be placed inside the pipe, the present system allows sacrificial anode to utilize the pipes' own fluid as the ionic pathway necessary for cathodic protection, hence the term "Self Contained Ionic Pathway".

Advantageously, the system according to the present invention allows the combination of sacrificial anodes with surface pipe systems, a combination that was not possible with conventional sacrificial anode.

By allowing the combination of sacrificial anodes with surface pipes, the sacrificial anode system according to the present invention helps prevent the corrosion of surface pipes. The resulting decrease in the corrosion of surface pipes is advantageous as, amongst other things, it increases health and safety, increases equipment protection, reduces the downtime of equipment due to repair and maintenance, increases production time and reduces the overall costs of equipment in long term operations.

In the following description, similar features in the drawings have been given similar reference numerals and in order to way down the figures and facilitate their understanding, some elements are not referred to in some figures if they were already identified in a preceding one.

Figure 2:
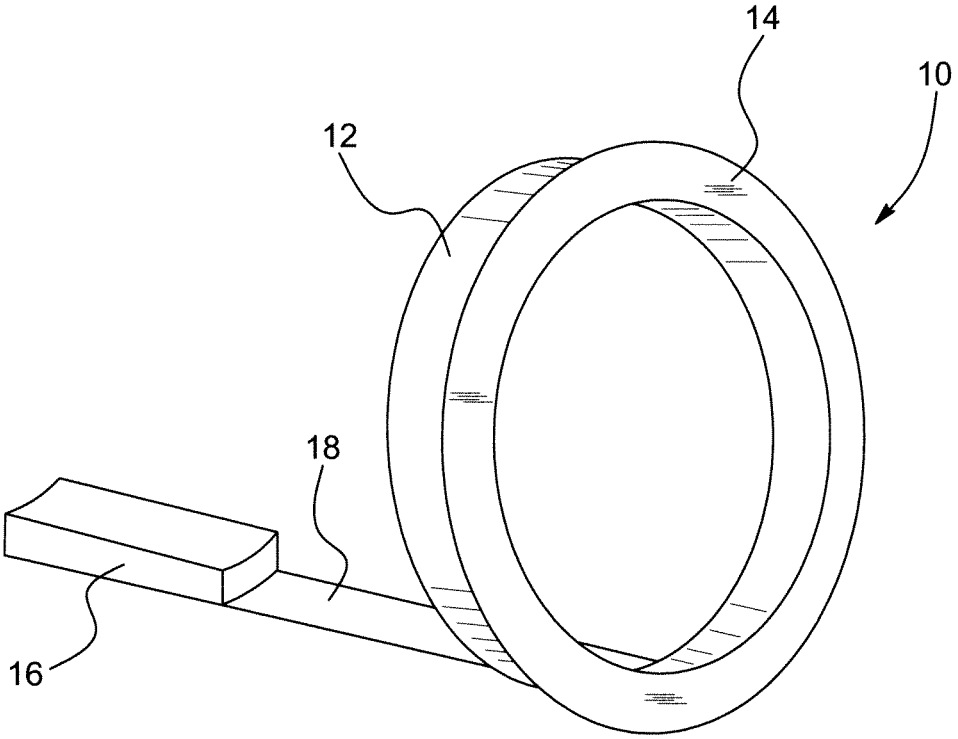
FIG. 2 is a perspective view of a sacrificial anode system according to a preferred embodiment of the present invention.
Figure 3:
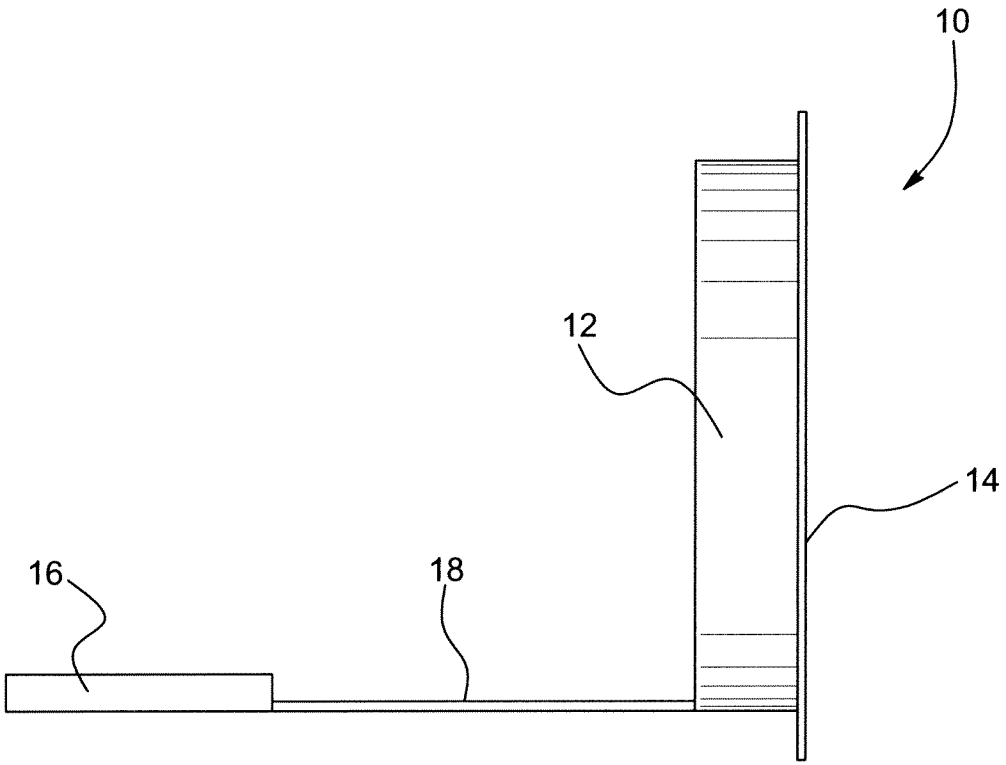
FIG. 3 is a side view of the sacrificial anode system shown in FIG. 1.
Figure 5:
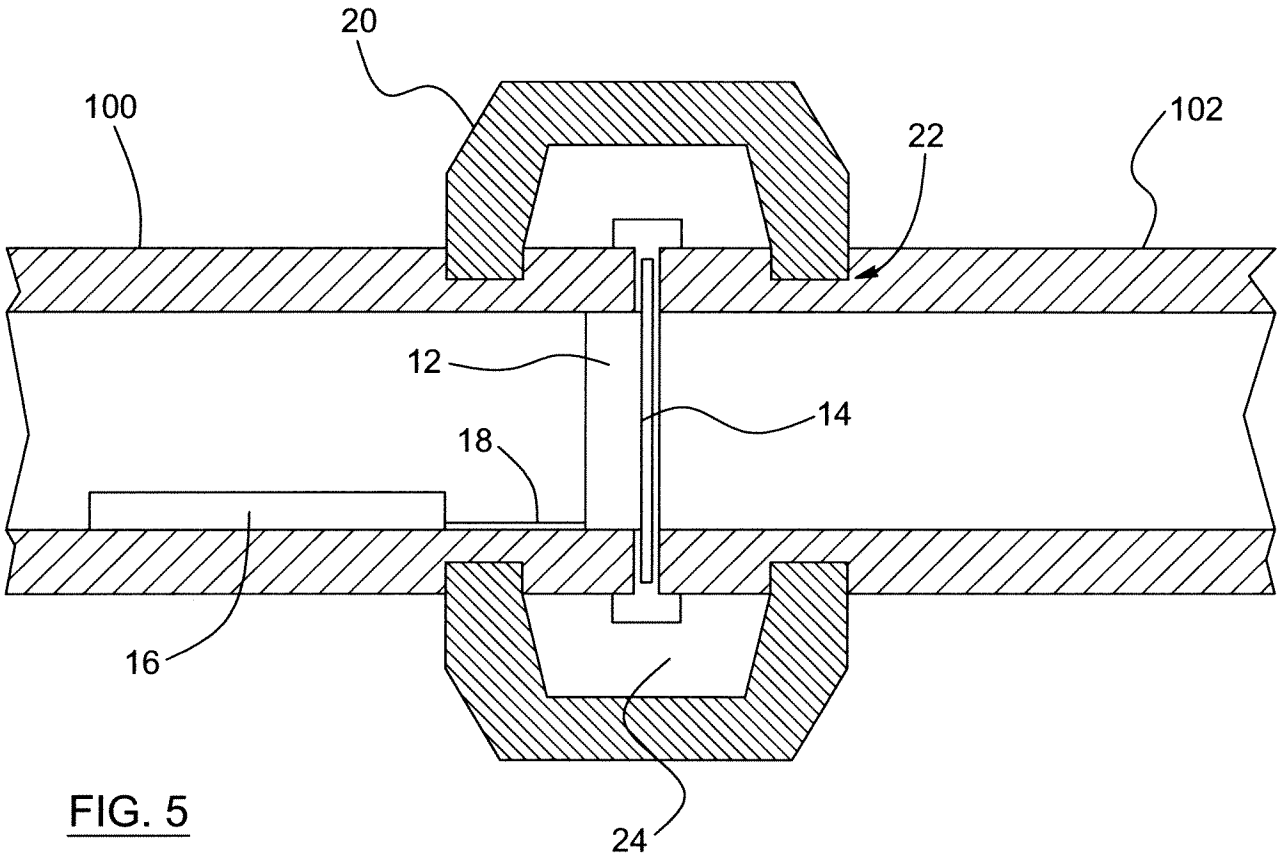
FIG. 5 is a cross-sectional view of a sacrificial anode system according to a preferred embodiment of the present invention installed in the grooved pipe shown in FIG. 4.

As shown in FIGS. 2, 3 and 5, according to a first aspect of the present invention, there is provided a sacrificial anode system 10 installable at an interface between a first pipe 100 and a second pipe 102. The sacrificial anode system comprises an insertion sleeve 12 shaped to fit along an inner surface of the first pipe 100; a flange 14 attached to the insertion sleeve 12 and shaped to rest against an end surface of the first pipe 100; a sacrificial anode 16 to be positioned within the first pipe 100; and a stem 18 linking the sacrificial anode to the insertion sleeve 12.

Figure 4:
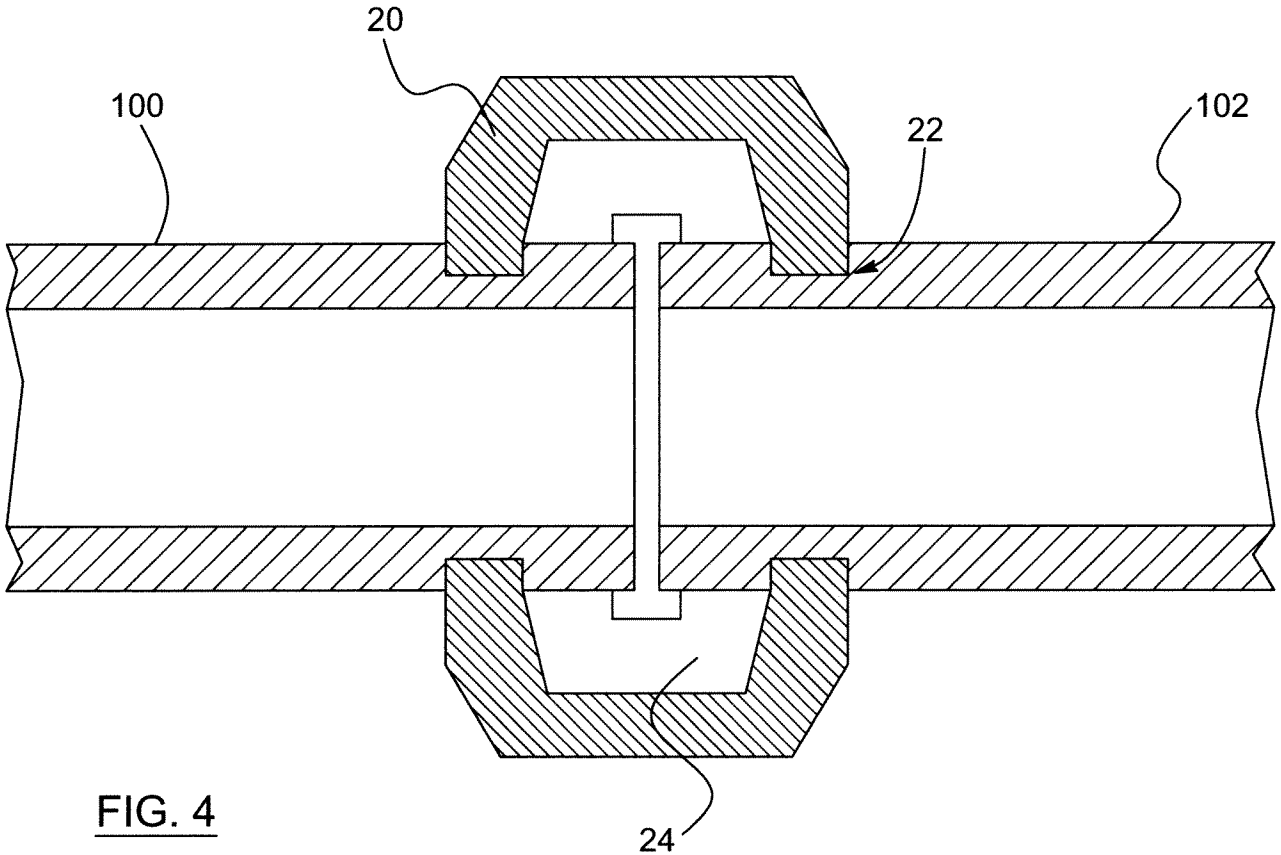
FIG. 4 is a cross-sectional view of a grooved pipe.
Figure 6:
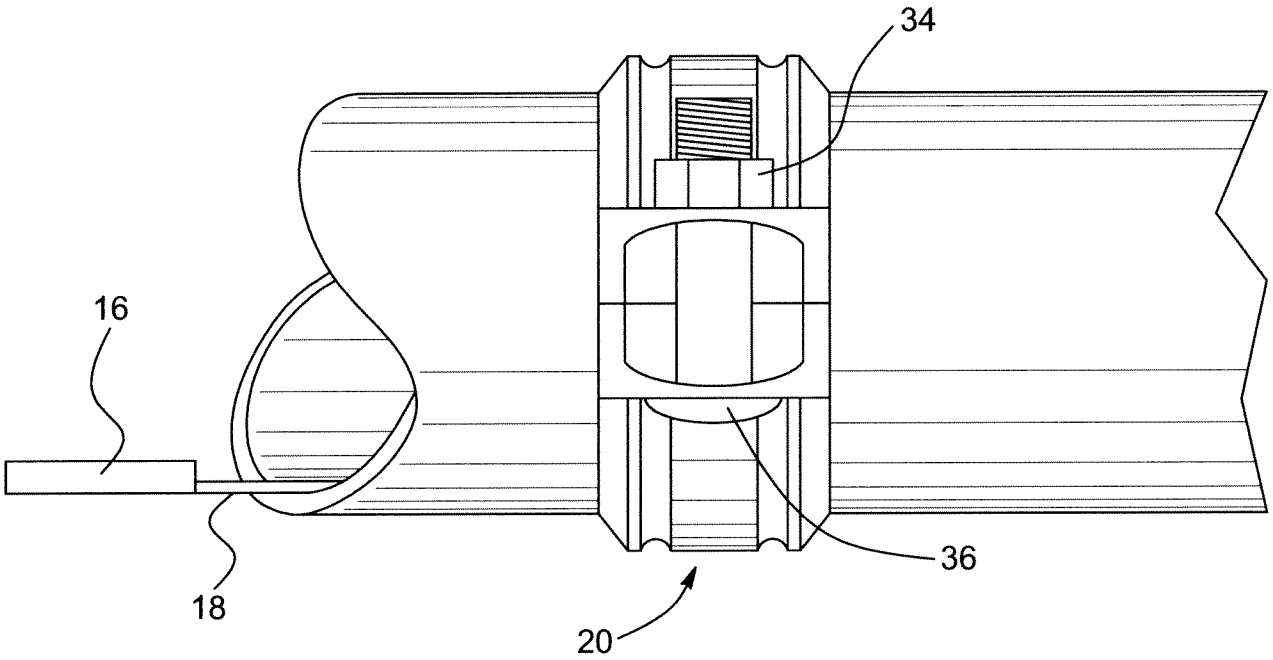
FIG. 6 is a side view of a grooved pipe showing the interface between two grooved pipe elements and a partial cut away view showing the sacrificial anode according to a preferred embodiment of the present invention.

As can be seen in FIGS. 4 to 6, the addition of the sacrificial anode system 10 at an interface of two pipes 100, 102 does not impact on the regular installation of the grooved pipes (i.e. the grooved pipes can be joined together using the same components and techniques regardless of the presence of the sacrificial anode system 10). The only difference between installing grooved pipes including the sacrificial anode system 10 and grooved pipes without the sacrificial anode system 10, is the additional step of inserting the sacrificial anode system 10 inside one of the pipe 100 prior to joining the pipes 100, 102 using the clamp 20.

FIG. 4 shows a cut away view of grooved pipes without the sacrificial anode system 10, while FIGS. 5 and 6 show grooved pipes provided with the sacrificial anode system 10. As can be seen in the Figures, in both cases the pipe structure includes first and second pipes 100, 102 with a clamp 20 adapted to fit within a pipe groove 22, and affixed through a nut 34 and bolt 36 interface. In both cases, the interfaces are also provided with a rubber gasket or seal 24, for sealing the joint and preventing leakage.

In a preferred embodiment of this first aspect of the present invention, and as better illustrated in FIGS. 2 and 3, the insertion sleeve 12 is circular in order to fit with the normally circular form of the grooved pipes, but could have a different form without departing from the scope of the present invention, as will be apparent to one skilled in the art.

Preferably, the sacrificial anode system 10, according to this first aspect of the invention, will be manufactured with insertion sleeve 12 and flange 14 of different diameters, in order to accommodate the different diameters of the associated grooved pipes.

Preferably the insertion sleeve 12 and the flange 14 are moulded from a single piece of material, but could also be attached together through other means such as welding or the like.

Still preferably, the stem 18 linking the sacrificial anode 16 to the insertion sleeve 12 is rigid, in order to stabilize the sacrificial anode 16 within the pipe 100, and the bottom side of the stem 18 and sacrificial anode 16 are curved in order to fit the normally circular form of the grooved pipes.

Figure 13B:
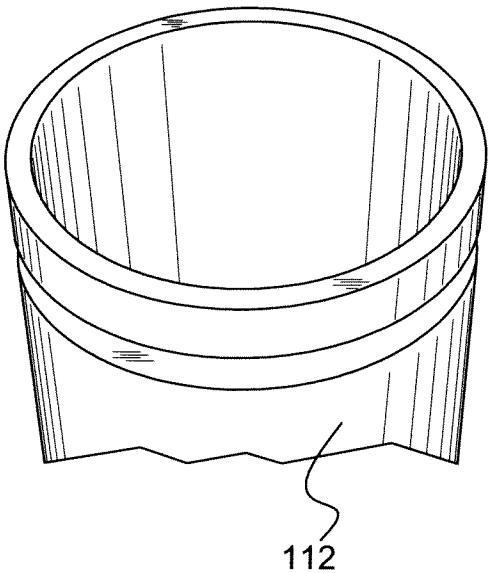
FIG. 13B is a perspective partial view of another type of grooved pipe that can be used with the sacrificial anode system according to a preferred embodiment of the present invention, wherein the inner surface of the pipe is free of inner ridge.
Figure 13A:
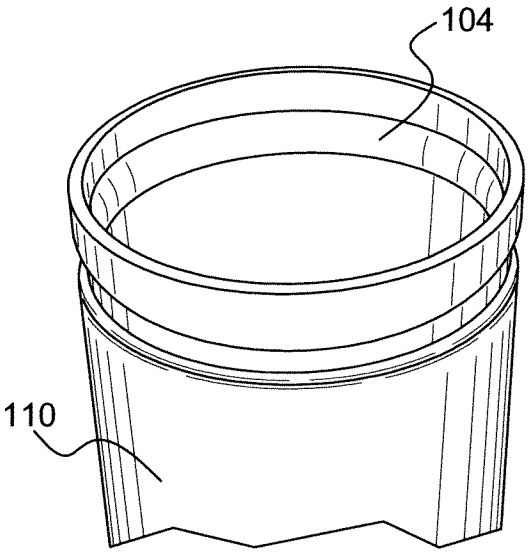
FIG. 13A is a perspective partial view of one type of grooved pipe that can be used in connection with the sacrificial anode system according to a preferred embodiment of the present invention, wherein the pipe is provided with an inner ridge along its inner surface and proximate to the pipe end.

As can be seen in FIGS. 13A and 13B, the sacrificial anode system can be used with different types of grooved pipes. These types of grooved pipes include pipes 110 provided with a ridge on their inner surface and proximate to the pipe end, as better shown in FIG. 13A, and pipes 112 without a ridge on their inner surface thereof, as illustrated in FIG. 13B.

Figure 7:
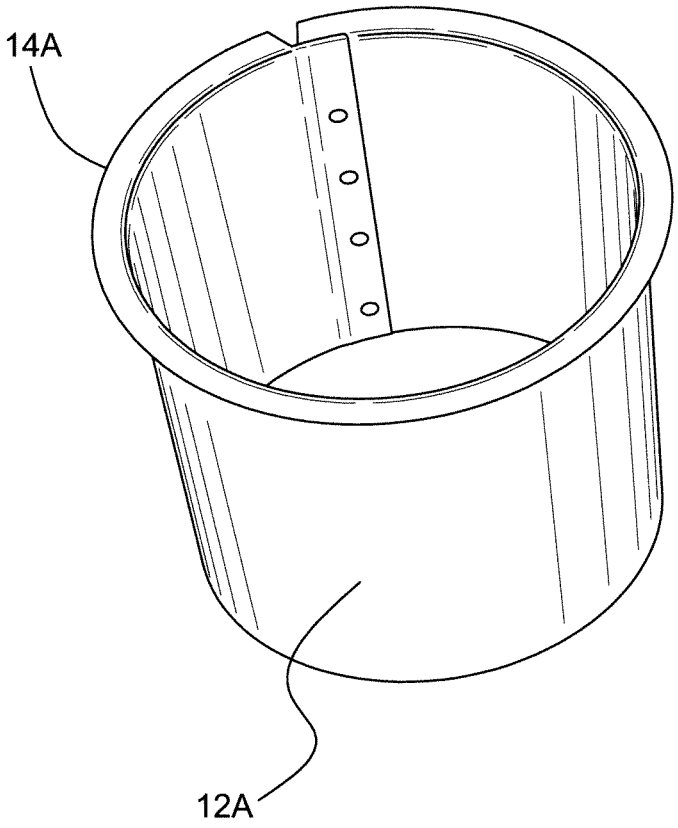
FIG. 7 is a perspective view of a preferred embodiment of the insertion sleeve and the flange of the sacrificial anode system of the present invention.
Figure 8:
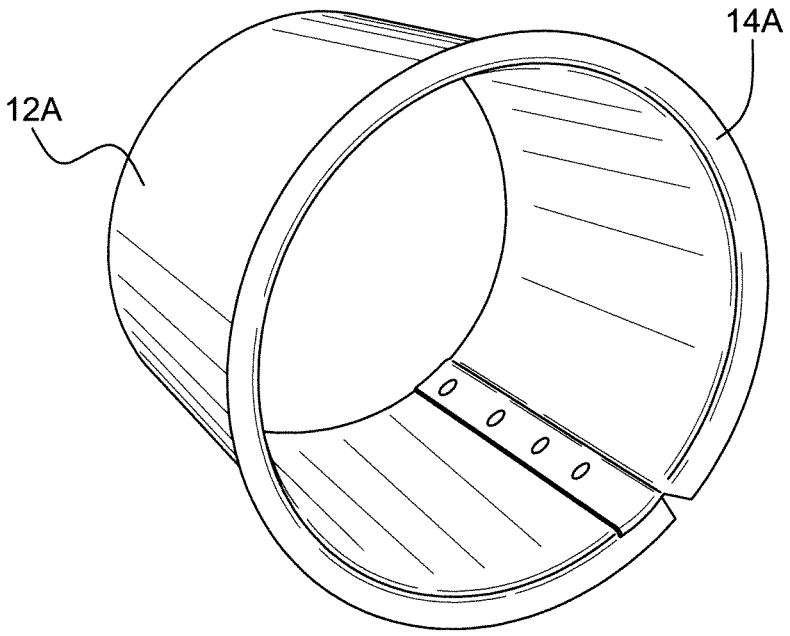
FIG. 8 is another perspective view of the insertion sleeve and the flange according to the preferred embodiment shown in FIG. 7.
Figure 9:
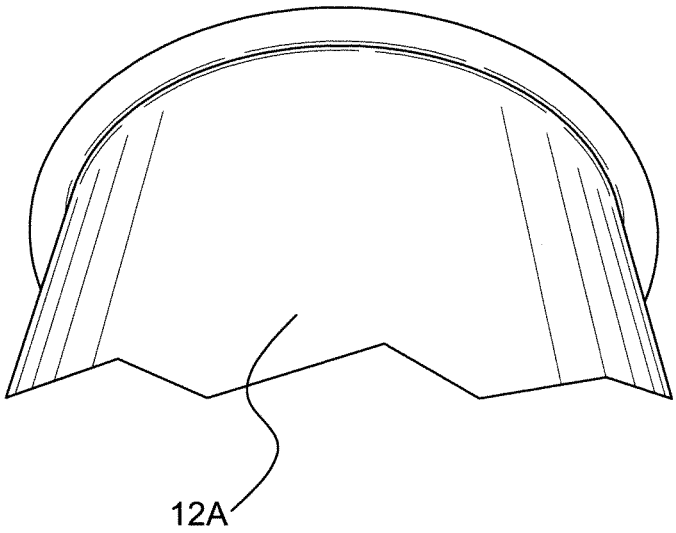
FIG. 9 is a perspective detailed view of the insertion sleeve and the flange according to the preferred embodiment shown in FIG. 7.

In a possible embodiment illustrated in FIGS. 7 to 9, the insertion sleeve 12A and the flange 14A of the sacrificial anode system 10 form an integral structure and the surface of the insertion sleeve 12A is smooth. The sacrificial anode system 10 according to this embodiment is designed to be used with pipes 112 having a smooth inner surface, as the one shown in FIG. 13B. Given the smooth inner surface of the pipe 112, a sacrificial anode system 10 according to this embodiment, and having a diameter matching that of the pipe in which it to be installed, will easily slide into the extremity of the corresponding pipe 112.

The installation of a sacrificial anode system 10 according to the above-described embodiment into the extremity of a pipe 110 having a ridge 104 on its inner surface, would however be problematic, since the ridge 104 would impede the insertion of the insertion sleeve 12A into the pipe 110.

Figure 10:
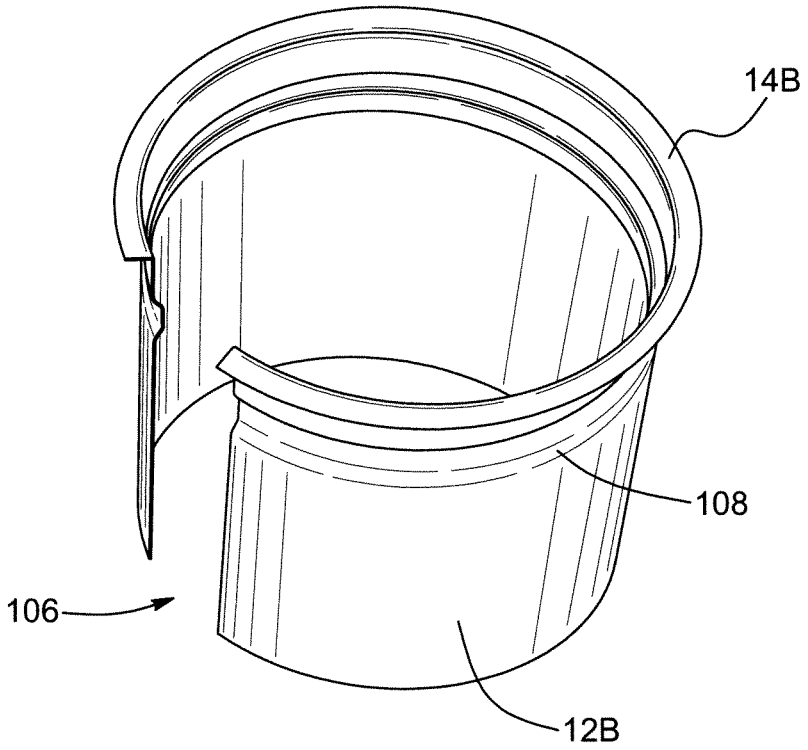
FIG. 10 is a perspective view of an alternative embodiment of the insertion sleeve and the flange of the sacrificial anode system of the present invention, wherein the insertion sleeve and the flange are provided with an opening and the insertion sleeve is provided with a sleeve groove.
Figure 11:
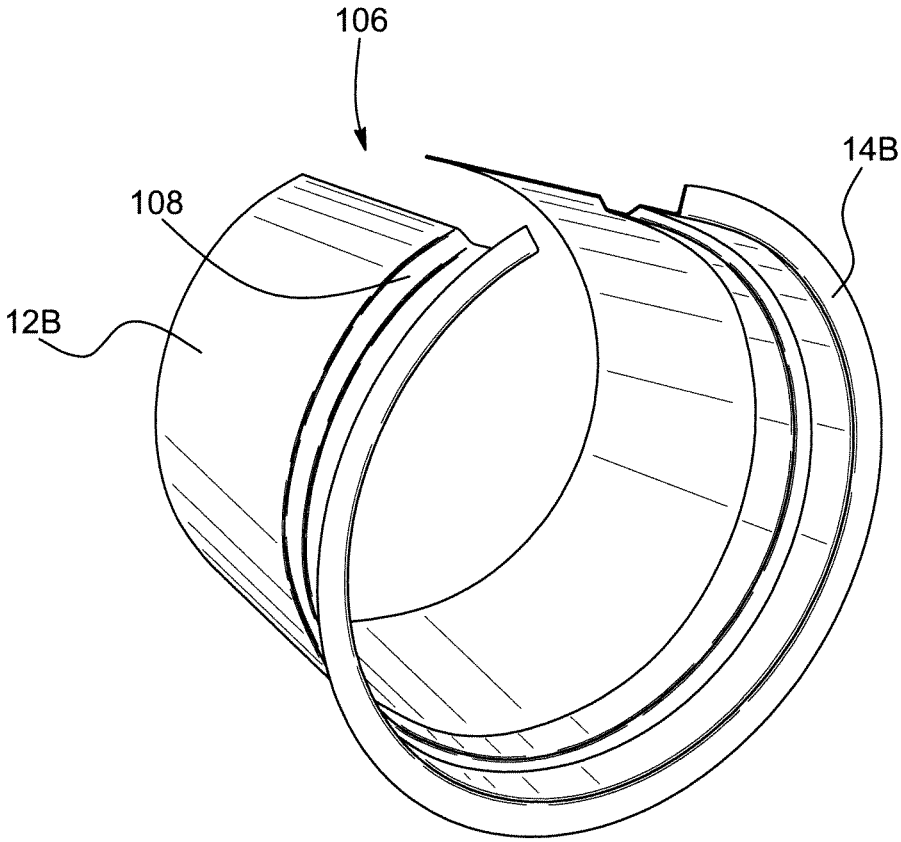
FIG. 11 is another perspective view of the insertion sleeve and the flange according to the alternative embodiment shown in FIG. 10.
Figure 12:
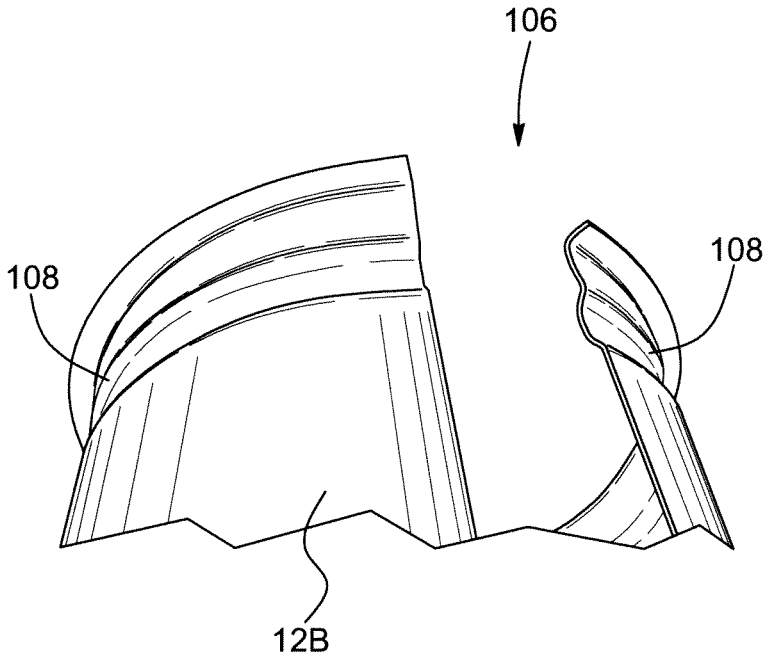
FIG. 12 is a perspective detailed view of the insertion sleeve and the flange according to the alternative embodiment shown in FIG. 10.

Therefore, in an alternative embodiment, as better illustrated in FIGS. 10 to 12, the insertion sleeve 12B and the flange 14B of the sacrificial anode system 10 comprise a slotted opening 106 for adjustment of the diameter of the insertion sleeve 12B and the flange 14B upon insertion of said sleeve 12B into a pipe 110 comprising an inner ridge 104 along its inner surface. The opening 106 extends perpendicularly along the entire length of the insertion sleeve 12B and the flange 14B, in order to allow easy contraction of the system 10. As a result, the diameter of the insertion sleeve 12B and the flange 14B will diminish when the insertion sleeve 12B travels over the ridge 104 located on the inner side of the pipe 110, and therefore allow smooth insertion of the sacrificial anode system 10 according to this alternative embodiment into pipes 110 of this type.

Still referring to FIGS. 10 to 12, in this alternative embodiment, the insertion sleeve 12B preferably further comprises a groove 108 (referred to as a sleeve groove) shaped to fit over the inner ridge 104 along the inner surface of the pipe 110, once the sacrificial anode system 10 is completely inserted into a pipe of this type 110. The sleeve groove 108 runs along the circumference of the insertion sleeve 12B and is located proximate to the flange 14B, since the inner ridge 104 of the pipe 110 is usually located proximate to the pipe end. The sleeve groove 108 allows the insertion sleeve 12B, to expand toward the inner side of the pipe 110 once the position of the sleeve groove 108 matches that of the inner ridge 104, and therefore, provides a better fit of the sacrificial anode system 10 into pipes 110 of this type.

A second aspect of the invention relates to a method for maintaining a surface pipe system provided with a sacrificial anode system. The method is based on the recording of the installation of the sacrificial anode system in a database for the purpose of future maintenance of the pipe system.

Knowing that sacrificial anodes have an expected life cycle, the steps of the method according to this second aspect of the invention are meant to ensure that the pipe systems maintain their integrity after the life cycle of the installed sacrificial anode is over.

Figure 14:
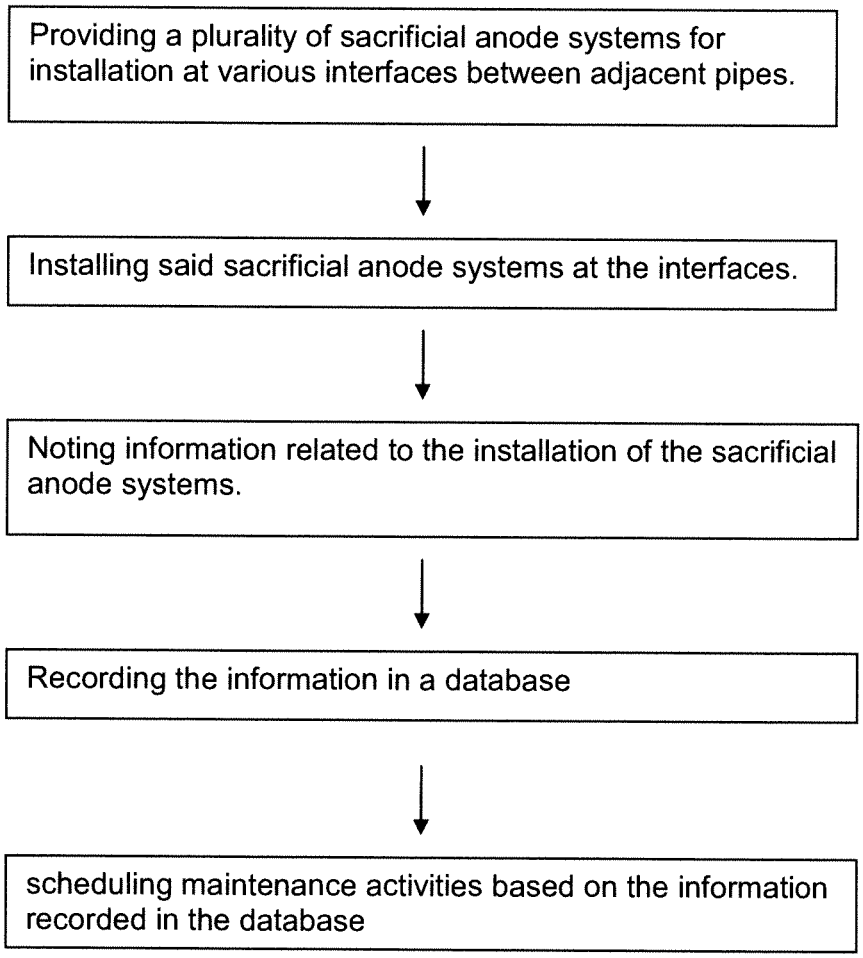
FIG. 14 is a flowchart representing the steps of the method according to another aspect of the present invention.

Consequently, according to a second aspect of the present invention and as better illustrated in FIG. 14, there is provided a method for maintaining a surface pipe system. The method comprises the steps of:

a) providing a plurality of sacrificial anode systems for installation at various interfaces between adjacent pipes;
b) installing said sacrificial anode systems at the interfaces;
c) noting information related to the installation of the sacrificial anode systems;
d) recording the information in a database; and
e) scheduling maintenance activities based on the information recorded in the database.

In a preferred embodiment, the sacrificial anode system that is referred to in step a) and installed according to step b) is a sacrificial anode system 10 hereinabove described in the first aspect of the present invention. The characteristics of this sacrificial anode system 10 were described above and need not be repeated here.

Still in accordance with this preferred embodiment, the noted and recorded information includes but is not limited to, the name of installer(s), the date of the installation, the location at the plant, mill, mine or the like and the life expectancy of the sacrificial anode. From this information, the expected replacement date of the sacrificial anode systems 10 can be estimated. This expected replacement date can also be included in the database.

Preferably, the above-mentioned database will be a computerized database. Such a computerized database allows the creation of associated software that can provide easy recording and consultation of the information by the concerned individuals, as well as easy scheduling of maintenance inspections and easy update of the recorded information based on the result of those maintenance inspections.

At the time of installation, the string of pipes can also be tagged or marked with a pipe wrap that contains the above-mentioned information or a portion of it. This physical tagging of the pipes enables easy consultation of the relevant information for maintenance technician, without having to resort to the above-mentioned database.

For example, if a pipe system comprising 1000 feet of pipes was installed at ABC plant and the system according to the present invention was incorporated to the pipe system by the installation of a sacrificial anode system 10 at every pipe connection (the sacrificial anode 18 used having a life expectancy of ten years). Using the method described hereinabove, a midway inspection can be scheduled to be carried by the maintenance personnel of the plant after half of the expected lifespan of the sacrificial anode has elapsed (i.e. after five years). This midway inspection would involve pulling apart a few random grooved pipes connections in order to inspect the condition of the sacrificial anodes 18 of the corresponding sacrificial anode system 10. Given the result of the inspection, a replacement date for the sacrificial anode systems 10, based on the deteriorated condition of the sacrificial anodes 18, can then be determined. The information entered in the database can subsequently be updated to reflect these results.

The application of the above-mentioned method for maintaining a pipe system provided with the sacrificial anode system 10 of the present invention results in a pipe system that is well maintained and corrosion free. Given that it is much cheaper to maintain a pipe system than it is to replace it, this solution can prove to be cost effective.

Although preferred embodiments of the present invention have been described in detail herein and illustrated in the accompanying drawings, it is to be understood that the invention is not limited to these precise embodiments and that various changes and modifications may be effected therein without departing from the scope of the present invention.

The invention claimed is:

1. A sacrificial anode system installable at an interface between a first pipe and a second pipe, said sacrificial anode system comprising:

an insertion sleeve shaped to fit along an inner surface of said first pipe;

a flange attached to said insertion sleeve and shaped to rest against an end surface of said first pipe;

a sacrificial anode to be positioned within said first pipe; and a stem linking said sacrificial anode to said insertion sleeve.

2. The sacrificial anode system of claim 1, wherein said insertion sleeve and said flange comprise an opening extending perpendicularly along an entire length of said insertion sleeve and said flange.

3. The sacrificial anode system of claim 2, wherein said insertion sleeve is provided with a groove running along the circumference of said insertion sleeve, proximate to said flange.

4. The sacrificial anode system of claim 1, wherein said stem is rigid.

5. The sacrificial anode system of claim 1, wherein said sacrificial anode is made of alloys of zinc, magnesium and aluminum.

6. A method for maintaining a surface pipe system, said method comprising the steps of:

a) providing a plurality of sacrificial anode systems for installation at various interfaces between adjacent pipes, each sacrificial anode system of the plurality of sacrificial anode systems comprising:

an insertion sleeve shaped to fit along an inner surface of a first pipe of said adjacent pipes;

a flange attached to said insertion sleeve and shaped to rest against an end surface of said first pipe;

a sacrificial anode to be positioned within said first pipe; and a stem linking said sacrificial anode to said insertion sleeve;

b) installing said sacrificial anode systems at said interfaces;

c) noting information related to the installation of said sacrificial anode systems;

d) recording said information in a database; and e) scheduling maintenance activities based on said information recorded in said database.

7. The method for maintaining a surface pipe system of claim 6, wherein said database is a computerized database.

8. The method for maintaining a surface pipe system of claim 6, said method further comprising the additional step of physically tagging the pipe with at least one of the information recorded in said database.

* * * * *